US007343131B2

(12) United States Patent
Nakajima

(10) Patent No.: US 7,343,131 B2
(45) Date of Patent: Mar. 11, 2008

(54) FIXING DEVICE HAVING A PRESSURE ROLLER AND IMAGE FORMING DEVICE EQUIPPED WITH THE SAME

(75) Inventor: Eiji Nakajima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 175 days.

(21) Appl. No.: 11/258,160

(22) Filed: Oct. 26, 2005

(65) Prior Publication Data

US 2007/0092314 A1 Apr. 26, 2007

(51) Int. Cl.
*G03G 15/20* (2006.01)

(52) U.S. Cl. ..... 399/333; 399/328

(58) Field of Classification Search ..... 219/216, 219/619, 328, 329, 330, 331
See application file for complete search history.

(56) References Cited

U.S. PATENT DOCUMENTS 5,319,430 A * 6/1994 DeBolt et al. ..... 399/322
7,218,884 B2 * 5/2007 Miyazaki ..... 399/328

* cited by examiner

*Primary Examiner*—Hoang Ngo
(74) *Attorney, Agent, or Firm*—Global IP Counselors, LLP

(57) ABSTRACT

A fixing device is provided with a heat roller (18) and a pressure roller (19) having a shaft (24) and an elastic layer (25) formed on a periphery thereof and being in pressurized contact with the heat roller (18). A concave region (25*b*), formed in an approximate arc shape in cross-section, is arranged on an end face (25*a*) of the elastic layer (25) in a longitudinal direction (X) of the pressure roller (19). Accordingly, even when the pressure roller (19) is in pressurized contact with the heat roller (18), since the concave region (25*b*) deforms to an approximately plane shape only, and the end face (25*a*) does not protrude outwards, the occurrence of cracking in the elastic layer (25) of the pressure roller (19) can be avoided.

10 Claims, 5 Drawing Sheets

FIXING DEVICE HAVING A PRESSURE ROLLER AND IMAGE FORMING DEVICE EQUIPPED WITH THE SAME

FIELD OF THE INVENTION

The present invention relates to a fixing device for fixing a toner image on a paper sheet, the device being provided with a heat roller having a heat source, a pressure roller having an elastic layer on its surface and being in pressurized contact with the heat roller, and relates to an image forming device equipped with the same, such as a copy machine, a printer, a facsimile, or the like.

BACKGROUND INFORMATION

Generally, in image forming devices such as copy machines, printing devices, facsimiles, or the like, that use electrophotographic methods, light based on an image read by an image scanner, is irradiated by an exposing device onto a surface of a photoreceptor that is an image holding body, an electrostatic latent image of this image is formed, and after that, toner is attached to this electrostatic latent image by a developing device, to form a toner image. After the toner image is transferred by a transferring device onto a paper sheet, the paper holding the toner image is sandwiched and fed into a nip formed by a pressure roller and a heat roller arranged in a fixing device, and the toner image is fixed to the paper by heating and pressurizing.

Furthermore, in recent years, with a view towards energy saving, fixing devices are proposed in which, by reducing diameters of the heat roller and the pressure roller in the fixing devices, with regard to heating quantity of a heat source for heating the heat roller, the heat quantity of the heat roller and the pressure roller is made relatively small. More specifically, for example, a fixing device is disclosed that is provided with a heat roller consisting of a small sized hollow roller made of metal with an external diameter of 15 mm or less and a wall thickness of 1 mm or less, and a small sized pressure roller having an elastic layer with an external diameter of 15 mm or less.

Here, as in the abovementioned conventional fixing device, when the diameters of the heat roller and the pressure roller are made small, it becomes difficult to ensure the width of the nip formed by the heat roller and the pressure roller. Consequently, implementing measures such as reducing the hardness of the elastic layer of the pressure roller, increasing the pressurizing force of the pressure roller acting on the heat roller, or the like, are necessary. However, in conditions with these types of measure implemented, if the pressure roller is in continuous pressurized contact with the heat roller, due to insufficient strength of the elastic layer of the pressure roller, or the like, as shown in FIG. 11, an end face 53*a* of the elastic layer 53 of the pressure roller 52 in contact with the heat roller 51 (that is, an end face in a longitudinal direction X of the pressure roller 52) bends. Thus, the end face 53*a* protrudes outwards, in the abovementioned longitudinal direction X, in comparison to a state before the pressure roller 52 is put in pressurized contact with the heat roller 51, as shown in FIG. 12. As a result, since tearing forces act on a joining face 56 of the elastic layer 53 and a shaft 55, as shown in FIG. 11, cracking 54 occurs in the abovementioned end face 53*a*, towards the joining face 56 of the elastic layer 53 and the shaft 55, and a problem arises in that the operating life of the pressure roller 52 becomes short.

Consequently, the present invention was made in view of the abovementioned problems, and has as an object the provision of a fixing device and an image forming device equipped with the same, that has a simple structure, that avoids occurrences of cracking in the elastic layer of the pressure roller, and in which the pressure roller has a long operating life.

SUMMARY OF THE INVENTION

In order to realize the abovementioned object, in a first aspect of the present invention, a fixing device comprises a heat roller having a heat source, and a pressure roller having a shaft and an elastic layer formed on the periphery thereof and forming, by being in pressurized contact with the heat roller, a nip through which paper sheets pass, wherein a concave region is arranged on an end face of the elastic layer in a longitudinal direction of the pressure roller. Here, in the first aspect of the fixing device according to the present invention, the concave region may be formed in an approximate arc shape in cross-section.

In a second aspect of the present invention, the fixing device comprises the heat roller having the heat source, and the pressure roller having the shaft and the elastic layer formed on the periphery thereof and forming, by being in pressurized contact with the heat roller, the nip through which the paper sheets pass, wherein an end portion of the shaft of the pressure roller is formed in a tapered shape, with an outer diameter gradually decreasing, from inside towards outside in the longitudinal direction of the pressure roller.

In a third aspect of the present invention, the fixing device comprises the heat roller having the heat source, and the pressure roller having the shaft and the elastic layer formed on the periphery thereof and forming, by being in pressurized contact with the heat roller, the nip through which the paper sheets pass, wherein the concave region, formed in an approximate arc shape in cross-section, is arranged on the end face of the elastic layer in the longitudinal direction of the pressure roller, and the end portion of the shaft of the pressure roller is formed in a tapered shape, with the outer diameter gradually decreasing, from the inside towards the outside in the longitudinal direction of the pressure roller.

Furthermore, an image forming device according to the present invention comprises the fixing device as in any of the above descriptions.

According to the first aspect of the present invention, the fixing device is configured so that the concave region is provided on the end face of the elastic layer in the longitudinal direction of the pressure roller, and in particular, the concave region is formed in an approximate arc shape in cross-section. Accordingly, the pressure roller can be realized with a simple structure, in which occurrences of cracking in the elastic layer of the pressure roller can be avoided, and with a long operational life.

Furthermore, according to the second aspect of the present invention, the fixing device is configured so that the end portion of the shaft of the pressure roller is formed in a tapered shape, with the outer diameter gradually decreasing, from the inside towards the outside in the longitudinal direction of the pressure roller. Accordingly, the pressure roller can be realized with a simple structure, in which occurrences of cracking in the elastic layer of the pressure roller can be avoided, and with a long operational life.

Furthermore, according to the third aspect of the present invention, the fixing device is configured so that the concave region, formed in an approximate arc shape in cross-section, is arranged on the end face of the elastic layer in the longitudinal direction of the pressure roller, and the end portion of the shaft of the pressure roller is formed in a tapered shape, with the outer diameter gradually decreasing, from the inside towards the outside in the longitudinal direction of the pressure roller. Accordingly, the pressure roller can be realized with a simple structure, in which occurrences of cracking in the elastic layer of the pressure roller can be assuredly avoided, and with an assuredly long operational life.

Furthermore, since the image forming device according to the present invention comprises the fixing device as in any of the above descriptions, it is possible to obtain the same effects as the fixing device in any of the above descriptions.

DETAILED DESCRIPTION OF THE PREFERRED EMBODIMENTS

Figure 1:
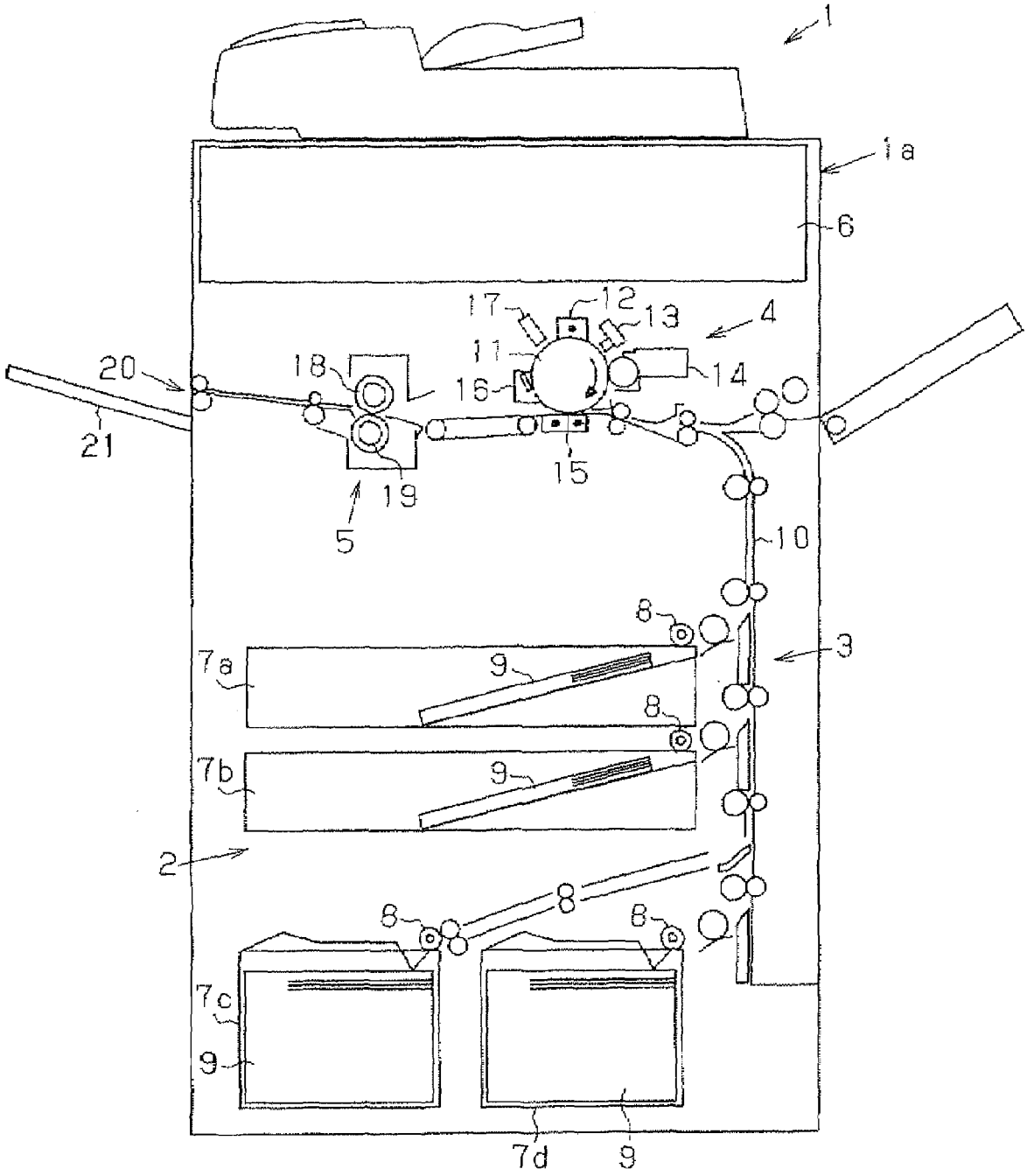
FIG. 1 is a schematic view of an overall configuration of an image forming device related to Embodiment 1 of the present invention.
Figure 2:
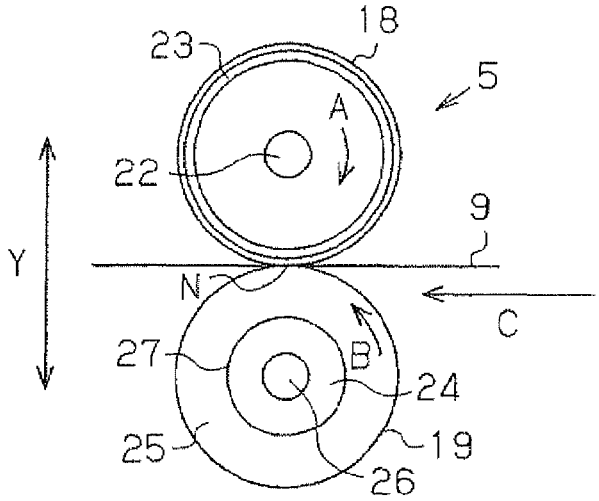
FIG. 2 is a schematic cross-sectional view of a fixing device related to Embodiment 1 of the present invention.

Below, specific embodiments of the present invention are explained, referring to the figures. FIG. 1 is a schematic view of an overall configuration of an image forming device related to Embodiment 1 of the present invention, and FIG. 2 is a schematic cross-sectional view of a fixing device related to Embodiment 1 of the present invention.

As shown in FIG. 1, the image forming device 1 is a copy machine, and comprises: a paper feeder 2 disposed below a main device unit la, a paper feeding system 3 disposed above and to the side of the paper feeder 2, an image forming unit 4 disposed above the paper feeding system 3, the fixing device 5 disposed so as to be towards an ejection side rather than the image forming unit 4, and an image reading device 6 disposed above the image forming unit 4 and the fixing device 5.

The paper feeder 2 comprises a plurality of paper feeding cassettes 7*a* to 7*d* (four cassettes in the present embodiment), in which paper 9 is accommodated, and is configured so that the paper 9 is discharged to the paper feeding system 3 side from a cassette selected from among the plurality of paper feeding cassettes 7*a* to 7*d*, by rotation of a feed roller (or a pickup roller) 8, and the paper 9 is assuredly fed, one sheet at a time, to the paper feeding system 3.

The paper 9 fed by the paper feeding system 3 is fed, via a paper supply path 10, towards the image forming unit 4. The image forming unit 4 forms a predetermined toner image on the paper 9, by an electrophotographic process, and comprises a photoreceptor 11 that is an image holding body axially supported with rotation enabled in a predetermined direction (an arrowed direction in the figure), and, around the photoreceptor 11 along the direction of rotation thereof, a charging device 12, an exposing device 13, a developing device 14, a transferring device 15, a cleaning device 16, and a neutralizing device 17.

The charging device 12 comprises a charging wire to which high voltage is applied, and by giving a predetermined electrical potential to the surface of the photoreceptor 11 by corona discharge from the charging wire, the surface of the photoreceptor 11 is uniformly charged. By the exposing device 13 irradiating light, based on image data of a document read by the image reading device 6, onto the photoreceptor 11, the surface potential of the photoreceptor 11 is selectively attenuated, and an electrostatic latent image is formed on the surface of the photoreceptor 11. Next, toner is attached to the abovementioned electrostatic latent image by the developing device 14, the toner image is formed on the surface of the photoreceptor 11, and the toner image on the surface of the photoreceptor 11 is transferred, by the transferring device 15, to the paper 9 supplied between the photoreceptor 11 and the transferring device 15.

The paper 9 to which the toner image has been transferred is fed from the image forming unit 4 to the fixing device 5. This fixing device 5 is disposed on the downstream side in the paper feed direction of the image forming unit 4, and as shown in FIG. 2, comprises a heat roller 18 having a heat source 22, and a pressure roller 19, having a shaft 24 and an elastic layer 25 formed on the periphery thereof, and by being put in pressurized contact with the heat roller 18, forms a nip N through which the paper 9 passes. Furthermore, an arrow C in the figure shows the feed direction of the paper 9.

A halogen lamp, for example, or the like, is used for the heat source 22 of the heat roller 18, and the heat source 22 in configured to heat a shaft 23, made of metal. Furthermore, the heat roller 18 is configured to be rotatable in the direction of an arrow A in the figure.

In addition, the pressure roller 19 comprises an elastic layer 25, arranged on the periphery of the shaft 24 that is made of metal, as a surface layer thereof, and is configured to be in pressurized contact with the heat roller 18, by a biasing means, not shown in the figure. Moreover, the length of the elastic layer 25 in a longitudinal direction X (see FIG. 3) of the pressure roller 19 is shorter than the length of the shaft 23 of the heat roller 18, and the configuration is such that the whole outer face of the elastic layer 25 is put in pressurized contact with the shaft 23. Furthermore, the elastic layer 25 is formed, for example, of silicon rubber or fluoro-rubber, and the configuration is such that when the pressure roller 19 is in pressurized contact with the heat roller 18, the elastic layer 25 deforms, and the nip N that the paper 9 passes through is formed. Moreover, the pressure roller 19 is axially supported by a rotation axis 26 to be rotatable in the direction of an arrow B in the figure, and the elastic layer 25 is joined, via a joining face 27, to the shaft 24. Furthermore, in the present embodiment, the heat roller 18 is configured so that the outer diameter thereof is 40 mm, and wall thickness is 1 mm, and the pressure roller 19 is configured so that the outer diameter thereof is 40 mm, and the thickness of the elastic layer 25 is 5 mm.

In the image forming unit 4, when the paper 9, on which the toner image has been transferred, passes through the nip N of the abovementioned heat roller 18 and the pressure roller 19, the configuration is such that the toner melts by heat from the heat source 22 of the heat roller 18, and the toner image is fixed on the paper 9.

Next, the paper 9 from the image forming unit 4, on which the image forming has been performed in the fixing device 5, is ejected by a pair of ejection rollers 20 onto an ejection tray 21. Moreover, after the abovementioned transferring, the toner remaining on the surface of the photoreceptor 11 is removed by the cleaning device 16, and the residual electric charge on the surface of the photoreceptor 11 is removed by the neutralizing device 17. The photoreceptor 11 is again charged by the charging device 12, and image formation the same as below is performed.

Figure 3:
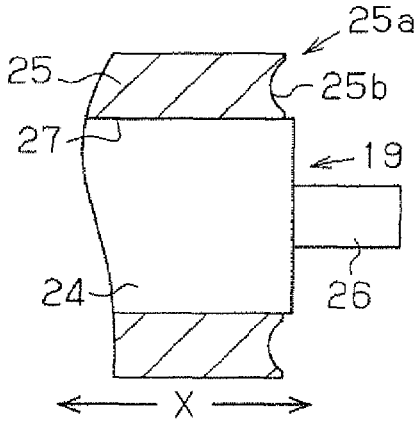
FIG. 3 is a schematic cross-sectional view describing the shape of an end face of an elastic layer of a pressure roller in the fixing device related to Embodiment 1 of the present invention, and shows a state before the pressure roller is put in pressurized contact with a heat roller.

Here, the distinguishing feature of the present embodiment is the shape of an end face of the elastic layer 25 in the longitudinal direction of the pressure roller 19. Below, this feature is explained in detail, referring to the figures. FIG. 3 is a schematic cross-sectional view describing the shape of the end face of the elastic layer of the pressure roller in the fixing device related to Embodiment 1 of the present invention, and shows a state before the pressure roller is put in pressurized contact with the heat roller. Moreover, FIG. 4 is a schematic cross-sectional view describing the shape of the end face of the elastic layer of the pressure roller in the fixing device related to Embodiment 1 of the present invention, and shows a state with the pressure roller in pressurized contact with the heat roller.

As shown in FIG. 3, in the present embodiment, a concave region 25*b* is arranged on the end face 25*a* of the elastic layer 25 in the longitudinal direction X of the pressure roller 19, and the concave region 25*b* is formed in an approximate arc shape in cross-section. In the state shown in FIG. 4, when the pressure roller 19 is put in pressurized contact with the heat roller 18, the elastic layer 25 is in contact with the heat roller 18, the heat roller 18 is pressed upon, and the nip N through which the paper 9 passes is formed.

Figure 4:
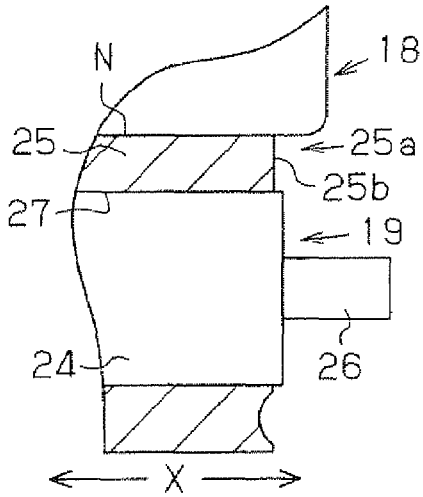
FIG. 4 is a schematic cross-sectional view describing the shape of the end face of the elastic layer of the pressure roller in the fixing device related to Embodiment 1 of the present invention, and shows a state with the pressure roller in pressurized contact with the heat roller.

At this time, as shown in FIG. 4, the elastic layer 25 deforms; however, in the present embodiment, as described above, since the concave region 25*b* is arranged on the end face 25*a*, and the concave region 25*b* is formed in an approximate arc shape in cross-section, even if the pressure roller 19 is put in pressurized contact with the heat roller 18, the concave region 25*b* deforms to an approximately plane shape only. That is, even if the pressure roller 19 is put in pressurized contact with the heat roller 18 as in the abovementioned prior art, since the end face 25*a* does not protrude outwards in the abovementioned longitudinal direction X, tearing forces do not act on the joining face 27 of the shaft 24 and the elastic layer 25.

Accordingly, the occurrence of cracking in the abovementioned end face 25*a*, towards the joining face 27 of the shaft 24 and the elastic layer 25, can be avoided, and additionally, long operative life can be realized for the pressure roller 19.

Figure 5:
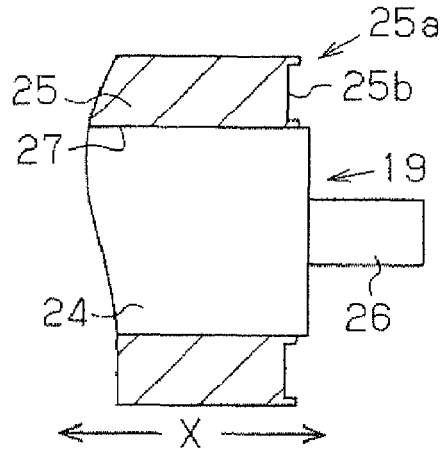
FIG. 5 is a schematic cross-sectional view showing a state in which the end face of the elastic layer of the pressure roller in the fixing device related to Embodiment 1 of the present invention is formed in an approximately square shape in cross-section, and shows a state before the pressure roller is put in pressurized contact with the heat roller.
Figure 6:
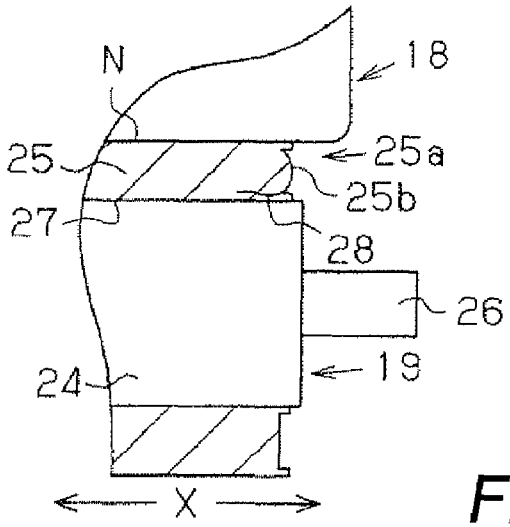
FIG. 6 is a schematic cross-sectional view showing a state in which the end face of the elastic layer of the pressure roller in the fixing device related to Embodiment 1 of the present invention is formed in an approximately square shape in cross-section, and shows a state with the pressure roller in pressurized contact with the heat roller.

Furthermore, as shown in FIG. 5, the abovementioned concave region 25*b* can be formed in an approximately square shape in cross-section. However, as shown in FIG. 6, if the concave region 25*b* is made in an approximately square shape in cross-section, as in the abovementioned prior art, when the pressure roller 19 is put in pressurized contact with the heat roller 18, the end face 25*a* bends and protrudes outwards, in the abovementioned longitudinal direction X. Accordingly, since, due to action of the tearing forces on the joining face 27 of the elastic layer 25 and the shaft 24, there are cases in which cracking 28 occurs, the approximate arc shape in cross-section is preferable to the approximately square shape in cross-section for the shape of the concave region 25*b*.

As in the above explanation, the present embodiment is configured such that the concave region 25*b* is arranged on the end face 25*a*, and also the concave region 25*b* is formed in an approximate arc shape in cross-section. Accordingly, the pressure roller 19 can be realized with a simple structure, in which the occurrence of cracking in the elastic layer 25 of the pressure roller 19 can be avoided, and with long operational life.

Figure 7:
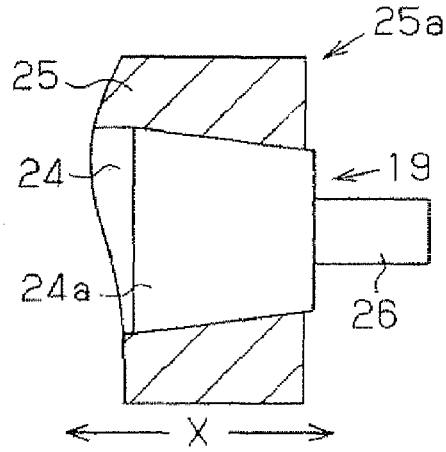
FIG. 7 is a schematic cross-sectional view describing the shape of an end portion of a shaft of the pressure roller in the fixing device related to Embodiment 2 of the present invention, and shows a state before the pressure roller is put in pressurized contact with the heat roller.
Figure 8:
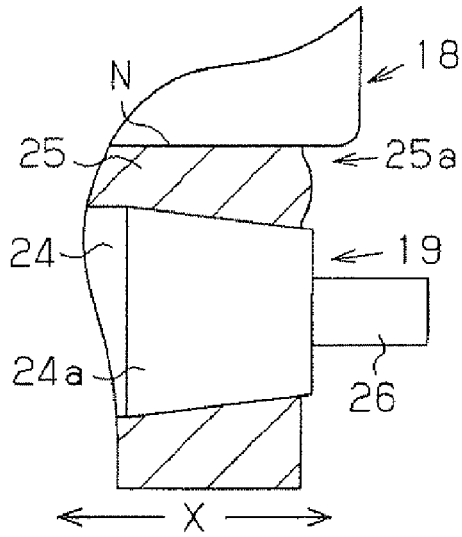
FIG. 8 is a schematic cross-sectional view describing the shape of the end portion of the shaft of the pressure roller in the fixing device related to Embodiment 2 of the present invention, and shows a state with the pressure roller in pressurized contact with the heat roller.

Next, Embodiment 2 of the present invention is explained. FIG. 7 is a schematic cross-sectional view describing an end portion of a shaft of a pressure roller in a fixing device related to Embodiment 2 of the present invention, and shows a state before the pressure roller is put in pressurized contact with a heat roller. Further, FIG. 8 is a schematic cross-sectional view describing the end portion of the shaft of the pressure roller in the fixing device related to Embodiment 2 of the present invention, and shows a state with the pressure roller in pressurized contact with the heat roller. Furthermore, in the present embodiment, component parts that are the same as in Embodiment 1 described above are given the same reference symbols and explanations thereof are omitted. In addition, the overall structure of the image forming device and the overall structure of the fixing device are the same as in Embodiment 1 described above, and so detailed explanations are omitted here.

The present embodiment is distinguished by the shape of the end portion 24*a* of the shaft 24 in a longitudinal direction of the pressure roller 19. As shown in FIG. 7, in the present embodiment, the end portion 24*a* of the shaft 24 of the pressure roller 19 is formed in a tapered shape with the outer diameter gradually decreasing, from the inside towards the outside in the longitudinal direction X of the pressure roller 19. Similar to Embodiment 1 as described above, in the state shown in FIG. 7, when the pressure roller 19 is put in pressurized contact with the heat roller 18, the elastic layer 25 comes into contact with the heat roller 18 and is pressed upon by the heat roller 18, so that a nip N, through which paper 9 passes, is formed.

Figure 11:
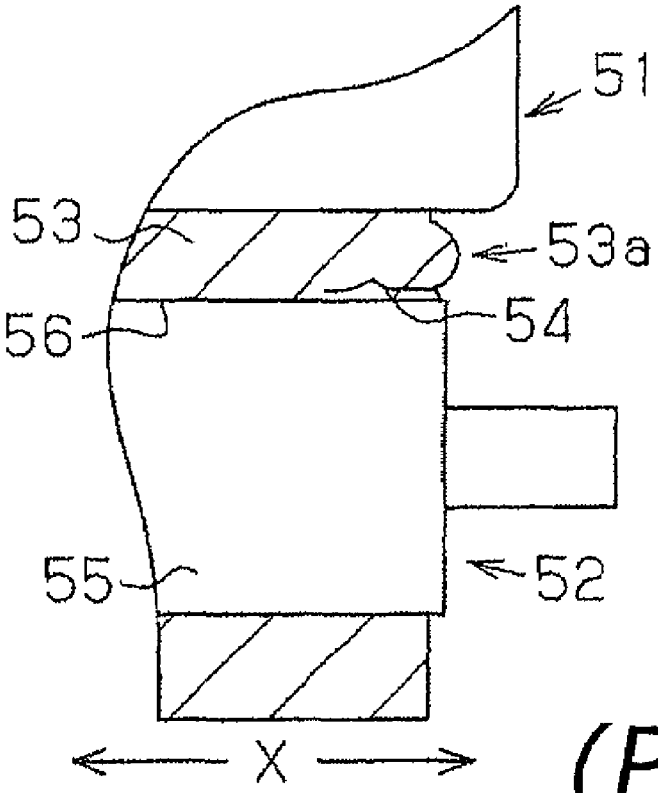
(Prior Art) Fig. 11
FIG. 11 is a schematic cross-sectional view describing the shape of an end face of an elastic layer of a pressure roller in a conventional fixing device, and shows a state with the pressure roller in pressurized contact with a heat roller.
Figure 12:
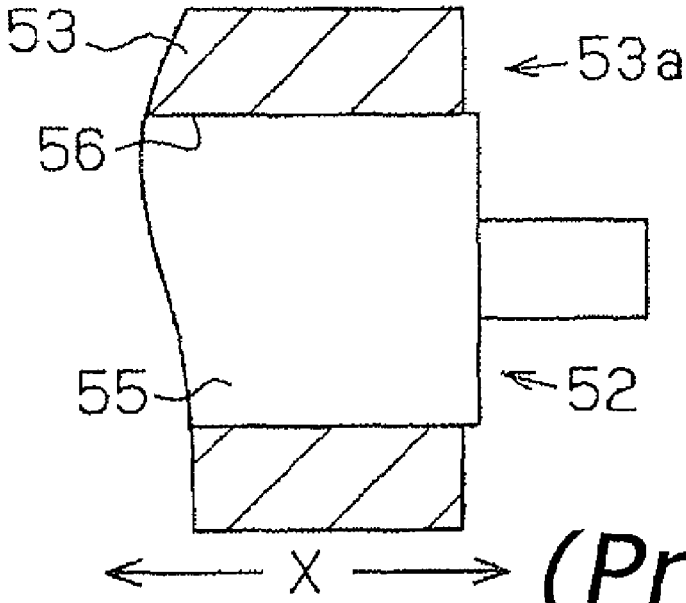
(Prior Art) Fig. 12
FIG. 12 is a schematic cross-sectional view describing the shape of the end face of the elastic layer of the pressure roller in the conventional fixing device, and shows a state before the pressure roller is put in pressurized contact with the heat roller.

At this time, as shown in FIG. 8, the elastic layer 25 deforms; however, in the present embodiment, as described above, the end portion 24*a* of the shaft 24 of the pressure roller 19 is formed in a tapered shape with the outer diameter gradually decreasing, from the inside towards the outside in the longitudinal direction X of the pressure roller 19. Accordingly, when the pressure roller 19 is put in pressurized contact with the heat roller 18, the end face 25*a* of the elastic layer 25 protrudes outwards in the abovementioned longitudinal direction X; however, compared to cases of the prior art as shown in FIG. 11, since the protrusion amount is lessened, it is possible to avoid negative effects due to tearing forces in a joining face 27 of the elastic layer 25 and the shaft 24.

Accordingly, similar to Embodiment 1 described above, the occurrence of cracking in the abovementioned end face 25*a*, towards the joining face 27 of the shaft 24 and the elastic layer 25, can be avoided, and also, long operative life can be realized for the pressure roller 19.

Furthermore, in the present embodiment, since the end portion 24*a* only of the shaft 24 is formed in the above described tapered shape, even in cases in which the pressure roller 19 is put in pressurized contact with the heat roller 18 by high fixing pressure (for example, a load of 400 N at the nip N), the pressure roller 19 does not bend in a Y direction (see FIG. 2) orthogonal to the abovementioned longitudinal direction X.

As explained above, the present embodiment is configured such that the end portion 24*a* of the shaft 24 is formed in a tapered shape with the outer diameter gradually decreasing, from the inside towards the outside in the longitudinal direction X of the pressure roller 19. Accordingly, the pressure roller 19 can be realized with a simple structure, in which the occurrence of cracking in the elastic layer 25 of the pressure roller 19 can be avoided, and with long operational life.

Furthermore, the abovementioned embodiments are merely explanatory examples, and the scope of the present invention is not limited by the abovementioned embodiments; form, size, material, and the like, of each component part are not excluded from the scope of the present invention and may be varied, within the spirit of the invention.

Figure 9:
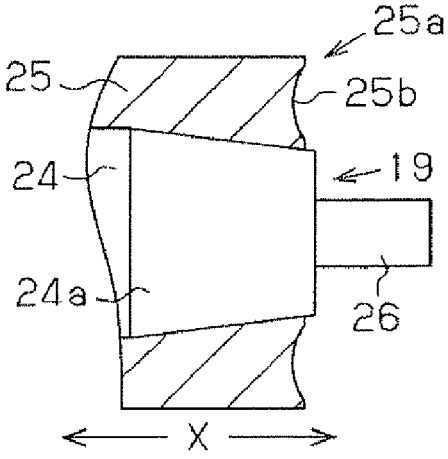
FIG. 9 is a schematic cross-sectional view showing a state in which the elastic layer shown in FIG. 3 is combined with the shaft shown in FIG. 7, and shows a state before the pressure roller is put in pressurized contact with the heat roller.
Figure 10:
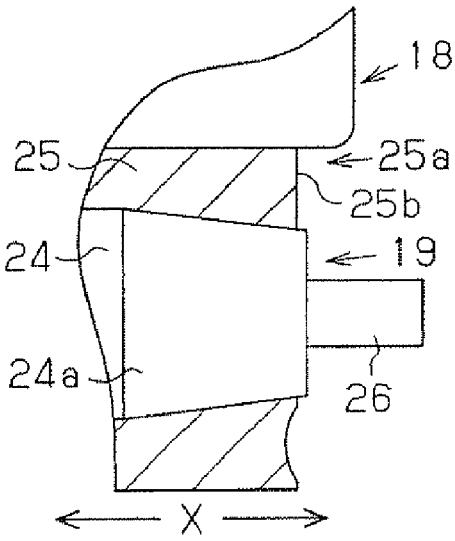
FIG. 10 is a schematic cross-sectional view showing a state in which the elastic layer shown in FIG. 3 is combined with the shaft shown in FIG. 7, and shows a state with the pressure roller in pressurized contact with the heat roller.

For example, as shown in FIG. 9, a configuration combining Embodiment 1 and Embodiment 2, as described above, is also possible. More specifically, the configuration is such that the concave portion 25*b* is arranged on the end face 25*a* of the elastic layer 25, and the concave portion 25*b* is formed in an approximate arc shape in cross-section; additionally, the end portion 24*a* of the shaft 24 of the pressure roller 19 is formed in a tapered shape with the outer diameter gradually decreasing, from the inside towards the outside in the longitudinal direction X of the pressure roller 19. With this type of configuration, the pressure roller 19 can be assuredly realized, with a simple structure, in which the occurrence of cracking in the elastic layer 25 of the pressure roller 19 can be assuredly avoided, and with long operational life. Furthermore, from a state shown in FIG. 9, the pressure roller 19 is put in pressurized contact with the heat roller 18, and the elastic layer 25 comes in contact with the heat roller 18 as in the state shown in FIG. 10.

Moreover, in Embodiment 1 described above, the concave region 25*b* is formed in an approximate arc shape in cross-section; however, if the shape is such that occurrence of cracking in the elastic layer 25 of the pressure roller 19 can be avoided, and long operational life can be realized for the pressure roller 19, any configuration is acceptable. For example, the concave region 25*b* can be formed in an approximate V-shape in cross-section. Furthermore, the end face 25*a* of the elastic layer 25 may be configured with a plurality of concave regions 25*b* having an approximate arc shape in cross-section.

In addition, in the embodiments described above, a digital copying machine is shown as one example of the image forming device; however, clearly, other image forming devices such as facsimiles, printers, or the like, are also feasible.

What is claimed is:

1. A fixing device comprising:

a heat roller having a heat source; and a pressure roller having a shaft and an elastic layer formed on a periphery thereof, and forming, by being in pressurized contact with the heat roller, a nip through which paper sheets pass, the elastic layer having a joining face arranged on an inner diameter, an outer periphery arranged on an outer diameter, and a concave region being arranged on an end face of the elastic layer in a longitudinal direction of the pressure roller, the concave region being arranged and configured to extend in the longitudinal direction between the joining face and the outer diameter, and the concave region forming a groove in the end face.

2. The fixing device according to claim 1, wherein the concave region is formed in an approximate arc shape in cross-section.

3. A fixing device comprising:

a heat roller having a heat source; and a pressure roller having a shaft and an elastic layer formed on a periphery thereof, and forming, by being in pressurized contact with the heat roller, a nip through which paper sheets pass, the shaft having a shaft portion extending along an axis of rotation having a constant diameter, and an end portion arranged on an end of the shaft portion of the pressure roller being formed to have a tapered shape with an outer diameter thereof gradually decreasing from the shaft portion towards outside in a longitudinal direction of the pressure roller.

4. A fixing device comprising:

a heat roller having a heat source; and a pressure roller having a shaft and an elastic layer formed on a periphery thereof, and forming, by being in pressurized contact with the heat roller, a nip through which paper sheets pass, a concave region formed in an approximate arc shape in cross-section being arranged on an end face of the elastic layer in a longitudinal direction of the pressure roller, and an end portion of the shaft of the pressure roller being formed in a tapered shape with an outer diameter thereof gradually decreasing from inside towards outside in a longitudinal direction of the pressure roller.

5. An image forming device, comprising:

a fixing device having a heat roller having a heat source, and a pressure roller having a shaft and an elastic layer formed on a periphery thereof, and forming, by being in pressurized contact with the heat roller, a nip through which paper sheets pass, the elastic layer having a joining face arranged on an inner diameter, an outer periphery arranged on an outer diameter, and a concave region being arranged on an end face of the elastic layer in a longitudinal direction of the pressure roller of the fixing device, the concave region being arranged and configured to extend in the longitudinal direction between the joining face and the outer diameter, and the concave region forming a groove in the end face.

6. An image forming device comprising:

a fixing device having a heat roller having a heat source, and a pressure roller having a shaft and an elastic layer formed on a periphery thereof and forming, by being in pressurized contact with the heat roller, a nip through which paper sheets pass, the shaft having a shaft portion extending along an axis of rotation having a constant diameter, and an end portion arranged on an end of the shaft portion of the pressure roller being formed to have a tapered shape with an outer diameter thereof gradually decreasing from inside the shaft portion towards outside in a longitudinal direction of the pressure roller of the fixing device.

7. An image forming device having a fixing device comprising:

a heat roller having a heat source; and a pressure roller having a shaft and an elastic layer formed on a periphery thereof, and forming, by being in pressurized contact with the heat roller, a nip through which paper sheets pass, a concave region, formed in an approximate arc shape in cross-section, being arranged on an end face of the elastic layer in a longitudinal direction of the pressure roller, and an end portion of the shaft of the pressure roller being formed in a tapered shape with an outer diameter thereof gradually decreasing, from inside towards outside in a longitudinal direction of the pressure roller, in the fixing device.

8. A fixing device comprising:

a heat roller having a heat source; and a pressure roller having a shaft and an elastic layer formed on a periphery thereof, and forming, by being in pressurized contact with the heat roller, a nip through which paper sheets pass, an end portion arranged on an end of the shaft of the pressure roller being formed to have a tapered shape with an outer diameter thereof gradually decreasing from inside towards outside in a longitudinal direction of the pressure roller, the elastic layer having an outer periphery with a constant diameter in the longitudinal direction.

9. A fixing device comprising:

a heat roller having a heat source; and a pressure roller having a shaft and an elastic layer formed on a periphery thereof, and forming, by being in pressurized contact with the heat roller, a nip through which paper sheets pass, an end portion arranged on an end of the shaft of the pressure roller being formed to have a tapered shape with an outer diameter thereof gradually decreasing from inside towards outside in a longitudinal direction of the pressure roller, the elastic layer having a thickness being configured to increase in the longitudinal direction from the inside towards the outside.

10. The fixing device according to claim 9, wherein the elastic layer has an outer periphery with a constant diameter in the longitudinal direction.

* * * * *